US006120183A

United States Patent [19]

Buchanan et al.

[11] Patent Number: 6,120,183

[45] **Date of Patent: *Sep. 19, 2000**

[54] CONTAINER AND METHOD OF MANUFACTURING SAME FROM A WEB OF FLEXIBLE MATERIAL

[75] Inventors: Jerry E. Buchanan, Acworth; Larry Sketo, Stockbridge; Rodney A. Buchanan, Marietta, all of Ga.

[73] Assignee: Technical Developers, Inc., Marietta, Ga.

[ * ] Notice: This patent issued on a continued prosecution application filed under 37 CFR 1.53(d), and is subject to the twenty year patent term provisions of 35 U.S.C. 154(a)(2).

[21] Appl. No.: 08/912,821

[22] Filed: Aug. 19, 1997

[51] Int. Cl.[7] ..... B65D 30/10

[52] U.S. Cl. ..... 383/122; 383/104; 383/107

[58] Field of Search ..... 383/104, 122, 383/903, 907, 107

[56] References Cited

U.S. PATENT DOCUMENTS

| | | | |
|---|---|---|---|
| 2,821,337 | 1/1958 | Morgan, Jr. . | |
| 3,380,646 | 4/1968 | Doyen et al. | 383/104 |
| 3,618,478 | 11/1971 | Piazze . | |
| 3,690,545 | 9/1972 | Pizzze . | |
| 3,750,937 | 8/1973 | Goodwin . | |
| 3,799,914 | 3/1974 | Schmit et al. | 383/104 X |
| 3,829,007 | 8/1974 | Ellison . | |
| 3,935,993 | 2/1976 | Doyen et al. | 383/104 X |
| 3,980,225 | 9/1976 | Kan | 383/104 |
| 4,428,477 | 1/1984 | Cristofolo . | |
| 4,453,370 | 6/1984 | Titchenal . | |
| 4,810,844 | 3/1989 | Anderson | 383/104 X |
| 4,904,093 | 2/1990 | Woods et al. | 383/104 X |
| 4,950,859 | 8/1990 | Anderson | 383/104 X |
| 4,974,732 | 12/1990 | Sullivan et al. | 383/104 X |
| 5,018,646 | 5/1991 | Billman et al. | 383/104 X |
| 5,135,464 | 8/1992 | Buchanan . | |
| 5,273,362 | 12/1993 | Buchanan . | |
| 5,356,069 | 10/1994 | Bochet et al. | 383/104 X |
| 5,437,406 | 8/1995 | Gordon et al. | 383/104 X |
| 5,468,206 | 11/1995 | Buchanan . | |

FOREIGN PATENT DOCUMENTS

| | | | |
|---|---|---|---|
| 2142276 | 1/1975 | France | 383/122 |
| 4087950 | 3/1992 | Japan | 383/104 |
| 5317112 | 12/1993 | Japan | 383/104 |
| 5330562 | 12/1993 | Japan | 383/104 |

*Primary Examiner*—Jes F. Pascua
*Attorney, Agent, or Firm*—Kennedy, Davis & Hodge LLP

[57] ABSTRACT

Containers (56) are produced from a sheet of flexible sheet material (10) having a sealable inner layer (12). The material is cut to expose the sealable inner layer when the material is folded upon itself so as to form a container having side seams (58) extending past the end walls of the container to prevent breaching and internal tabs (30) to prevent capillary leakage.

2 Claims, 10 Drawing Sheets

CONTAINER AND METHOD OF MANUFACTURING SAME FROM A WEB OF FLEXIBLE MATERIAL

TECHNICAL FIELD

This invention relates to containers made of flexible materials and to methods of manufacturing such containers.

BACKGROUND OF THE INVENTION

Containers made of flexible materials, such as from thin sheets of plastics, offer distinct advantages over metallic cans, bottles and the like. For example, they are lighter, far less expensive to produce, and easier to discard. However, they have, to date, had their own problems and limitations. For example, being made of such thin and flexible materials they have not had the sturdiness of cans and glass or rigid plastic bottles nor the stability of such when filled and stood uprightly. To overcome this problem flexible material containers have been formed with reinforced bottoms or sides as shown in U.S. Pat. No. 5,135,464. For efficiency of manufacture such reinforcements have been formed by doubling of the layers of plastic film in selected locations along or adjacent to the container bottoms as they are manufactured from a continuous web. The doubled layers are fused by heat sealing. However, with such construction multiple layers of film are brought together at junctions wherein as many as six layers often meet and are fused. This has resulted in constructions that possess capillary leaks that can lead to degradation in characteristics of goods stored therein over time or the leakage of goods therefrom.

Another problem associated with such containers has been their lack of consistency of production. In their manufacture a continuous web of thin plastic material is drawn through a series of forming stations where the web is folded and refolded, cut and heat sealed in various locations. In doing so, the web is passed through sets of drive and idle rollers and over various guide bars. Quite naturally it has been difficult to control the thin, flexible web as it is intermittently pulled, twisted, pressed and heated with a degree of accuracy and consistency as to produce substantially identically constructed containers. This fact has also served to limit the minimal thickness of the web since the thinner the material the more difficult it is to control during manufacture.

Another problem associated with flexible containers has been their propensity to burst open or otherwise breach should they be dropped. This breaching of the container typically occurs along the junction of the seams wherein the sides of the dropped container bellow outwardly from each other thereby ripping the side seams open.

It thus is seen that there remains a need for flexible containers of improved construction and of methods of manufacturing containers made from very thin, flexible webs or sheets of material with improved accuracy and consistency of construction and yet which produce sturdy containers that are substantially free of capillary leaks and that are resistant to breaching. Accordingly, it is to the provision of such that the present invention is primarily directed.

SUMMARY OF THE INVENTION

In a preferred form of the invention, a container is made of a sheet of flexible material having two opposed sides that extend from sides of a bottom along two opposed inverted V-shaped junctures. The sides are sealed together along two side seals that have side seal extensions which extend outside of the bottom spaced from the sides. Two opposed, inverted V-shaped reinforcement seals extend outwardly from the two bottom to sides junctures and from the side seal extensions.

In another preferred form of the invention, a method of manufacturing a container from a web of flexible material comprises the steps of folding the web along a fold to form two layers each having a bottom portion located adjacent the web fold and an upper portion. Cutouts are formed in the bottom portion of each layer at spaced intervals that extend from each side of the web fold. The upper portion of the two web layers are heat sealed together alongside heat seals aligned with the bottom cutouts with the ends of the side heat seals spaced from the cutouts in the bottom portions by bottom portions aligned sections aligned with the upper portion side seals. The bottom portions of the two layers are folded upon themselves into two bottom folds and the bottom portions aligned sections heat sealed together to form side seal extensions. Portions of the bottom portions are heat sealed together adjacent the side seal extensions and the web severed along the side seals and side seal extensions.

DETAILED DESCRIPTION

Figure 1:
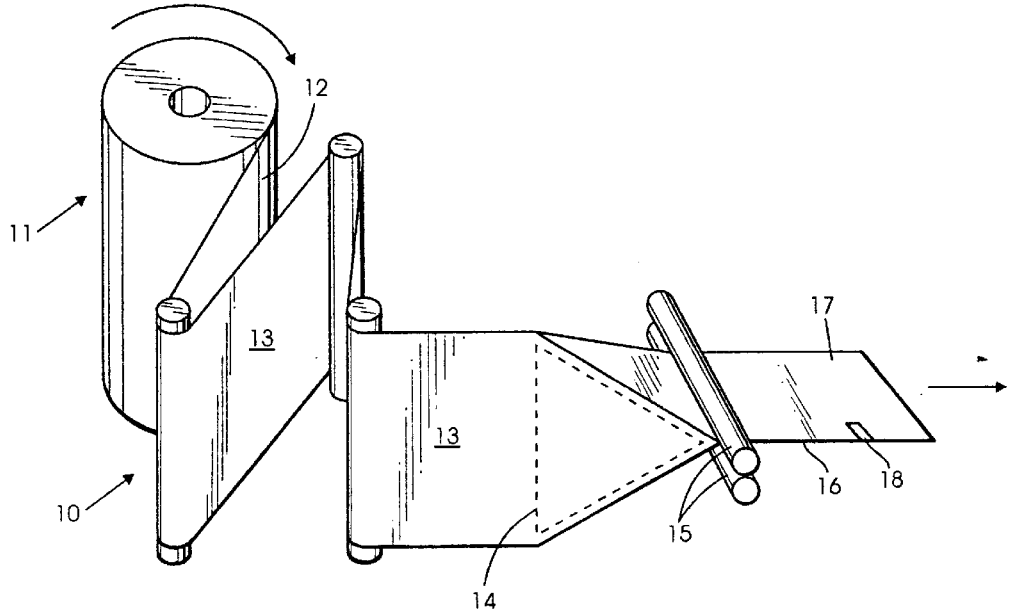
FIGS. 1–7 are perspective views of an initial series of steps taken in constructing a container from a web of flexible material.

With reference next to the drawings, there is shown in FIG. 1 a sheet or web 10 of thin plastic material being dispensed from a roll 11. The web 10 here is of a two-ply construction consisting of a layer of heat sealable polyethylene and a layer of imprintable polyester, although both layers may be polyethylene. The sealable polyethylene layer is indicate at 12 while the polyester layer is shown at 13. Representative of the thinness of the web, the polyethylene ply may be 2-½ mils and the polyester layer ½ mil.

The web is drawn over a V-shaped forming plow 14 and then through two rollers 15 which causes the web to be folded in half along its longitudinal center into two overlaying layers 10' with the sealable layer 12 of each layer oriented toward each other, i.e. face to face. Short heat seals 18 are then formed at regular intervals that extend from the folded edge or crease 16 of the web a short distance towards the opposite edges 17. It should be understood that throughout the description of the method the steps of heat sealing are shown with cross hatch lines in the drawings while previously sealed portions are shown with stippling.

The spacing between each of the short seals 18 basically establishes the widths of the containers being formed. These seals serve to stabilize the two layers of the folded material so that they do not shift or skew with respect to one another. Following the heat sealing, which may be made at some 230° F., the heat seal is cooled to between 110° to 150° F. in order to allow the web to be sheared. This is done following each seal formed in the web throughout the process but is not shown in the drawing for simplicity of illustration. It should be understood however that with some alternative materials such cooling may not be necessary.

Figure 2:
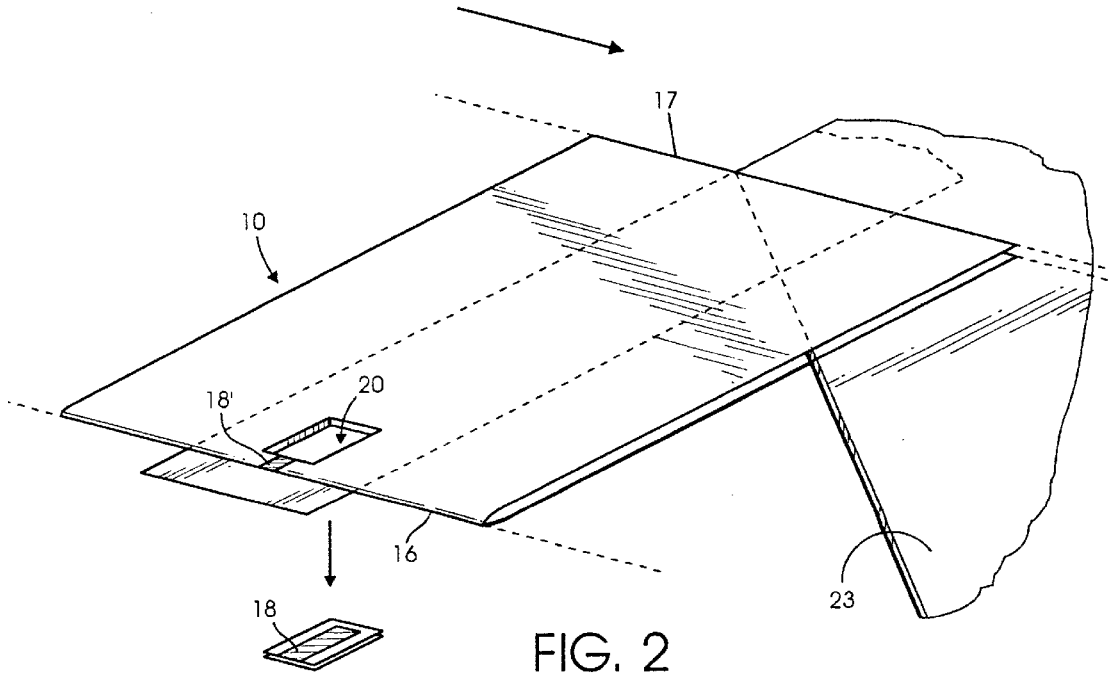

Next a rectangular die cutout 20 is formed in the folded web thereby removing a portion of the cooled heat seal 18, as with a conventional male-female die cutter, as shown in FIG. 2. Note that the cutout 20 is positioned spatially from the crease 16 of the web thereby leaving a segment 18' of the heat seal that extends from the crease 16. Note too that the die cutout 20 completely removes the remainder of the seal 18 which is shown falling free and which is wider than the remaining segment 18'. It should be noted that the two folded web layers here are shown spaced from each other only for clarity of illustration.

Figure 3:
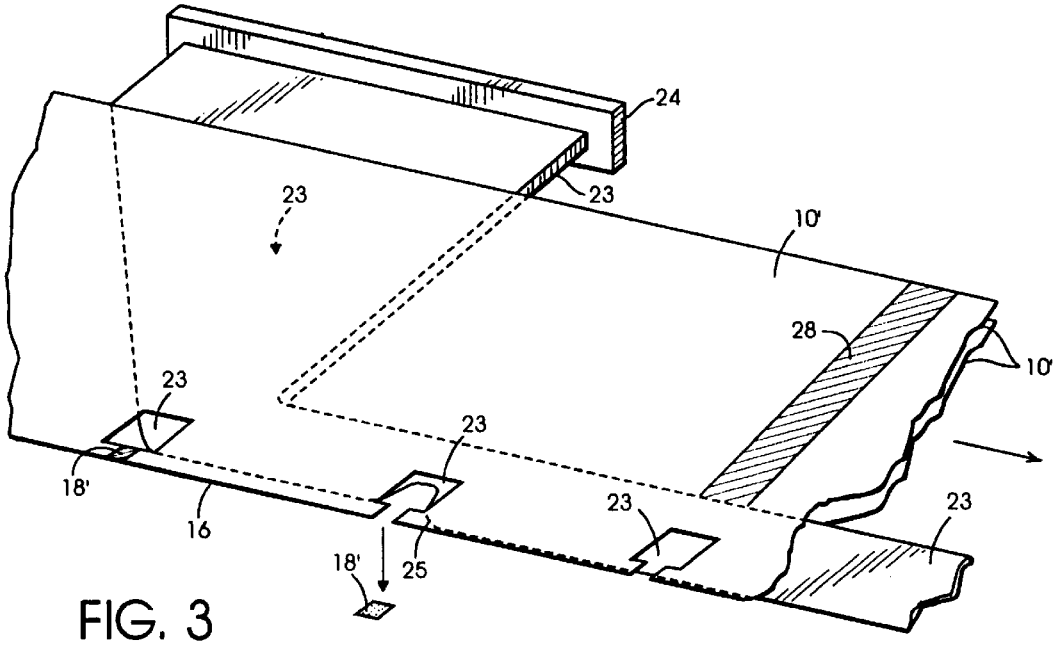

Next the folded web is drawn over a forming bar 23 that is mounted to a bar mount 24 located beside the path of travel of the web so that its two web layers 10' straddle the forming bar 23, as shown in FIG. 3. Here the forming bar is located between the two web layers 10' and their unfolded edges 17, initially spaced from the seal segment 18' and die cutout 20. The forming bar is tapered however such that shortly after the web is encounter the forming bar extends between the web layers 10' to a location adjacent the web crease 16. The forming bar also has an indentation 25 therethrough so that the thin seal segment 18' of the web located between crease 16 and the die cutout 20 may be now also cut out, as shown. The segment 18' is cut out once this portion of the web passes over the forming bar 23 so as to prevent the web from being jammed against the bar here upon initial contact. Also to prevent jamming the forming bar is thicker before the indentation 25, i.e. to the left of it in FIG. 3, than after the indentation, i.e. to the right of it. In this regard it should be appreciated that the web is traveling quite fast. For example where the containers are four inches wide and the cut-outs are thus spaced apart four inches, 100 containers a minute runs entail a web speed of 400 inches a minute if the heat sealing, cooling and cutting dies move along with the web, and ever quicker when the web is periodically halted during sealing, cooling and cutting operations. Thus jam free operation is virtually essential.

A side heat seal 28 is formed aligned with but spaced from the now expanded cutout 20. These seals eventually form the side seals which extend between the top and bottom of the finished containers. Note that at this stage the forming bar 23 is located only within that portion of the web that extends from the end of the side seals 28 to the web or crease 16. As the bar substantially fills this space in the web, which is not closed at each side, movement of the web is highly controlled. At this point the forming bar may be some 3/16" to 1/4" thick. This portion of the web that now surrounds the forming bar will eventually form the container bottoms. As will later be more fully appreciated, for 2 inch wide container bottoms the bar here is 2 inches wide.

Figure 4:
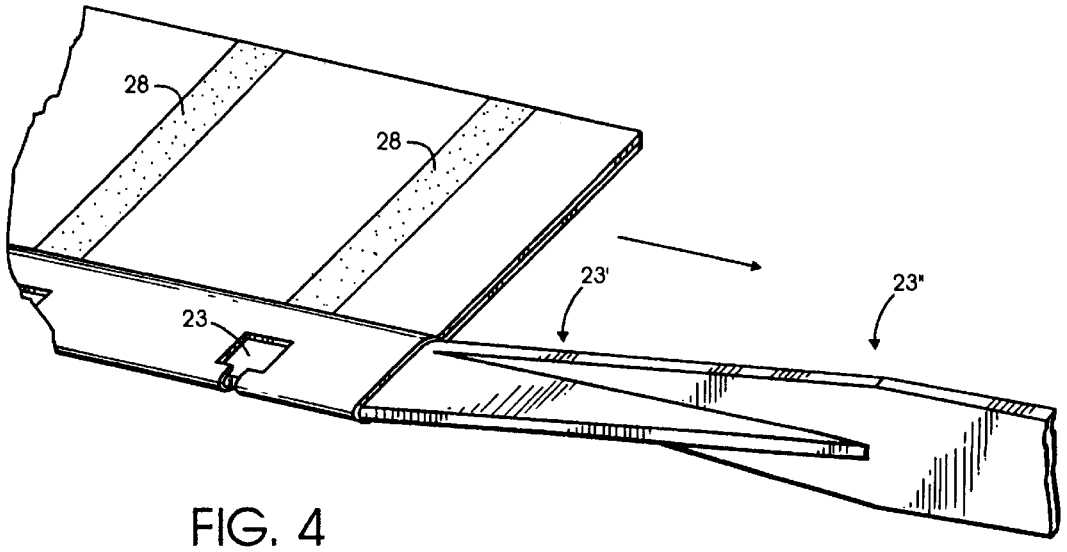
Figure 5:
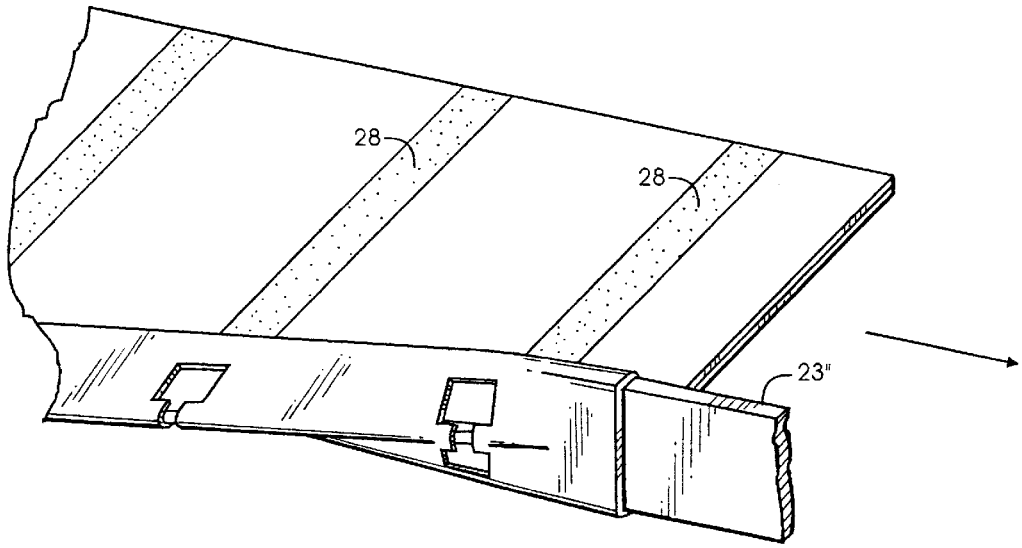
Figure 6:
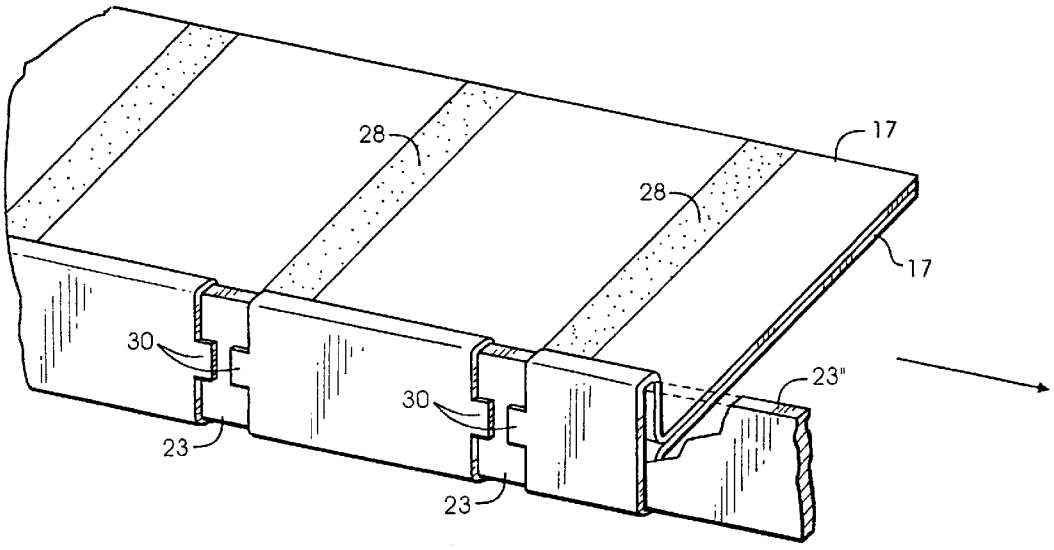

With reference next to FIG. 4, the portion of the forming bar 23 that the web is next drawn over is seen to make a tapered transition first from a flat, horizontal shape 23', to a T-shape, and then again to a flat, vertical shape 23" that is at a right angle to its original orientation. Thus as the bottom section of the web is pulled over this transitional section of the forming bar, it too is reoriented into a vertical plane that is at a right angle to its upper section as shown in progress in FIG. 5. The two adjoining cutouts 20, with segments 18' also having been cut away, now lie in a common plane, each bounded by two longitudinally aligned tabs 30, as shown in FIG. 6. It should be understood that the references to horizontal and vertical herein are for ease of illustration and is not intended to represent gravity dependent operation but rather ultimate, normal self-standing container orientation.

Figure 7:
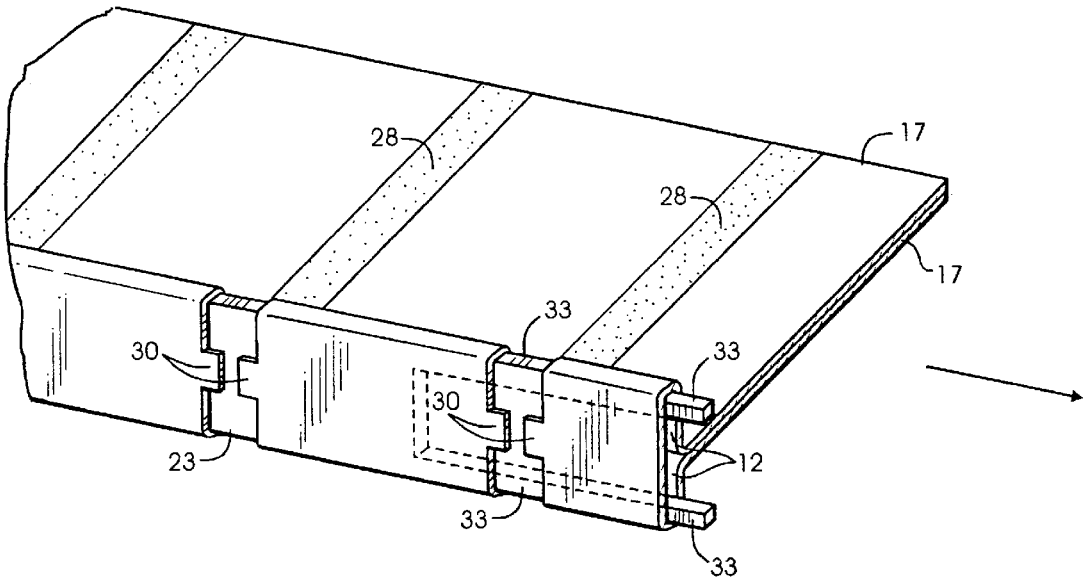
Figure 8:
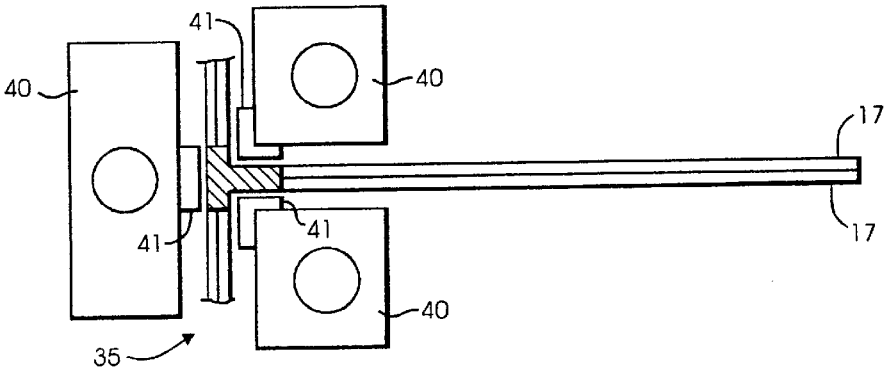
FIG. 8 is an end view of heating apparatus employed in forming the heat seals shown being formed in FIG. 7.

The web is next passed over an end portion of the forming bar that is in the shape of two, mutually spaced, parallel forks 33, as shown in FIG. 7. As the web is pulled over this section its opposed thermally sealable layers 12, now face and lie in close proximity to each other. The tabs 30 are now heat sealed, as with the heating apparatus 35 shown in FIG. 8, to the heat sealable layer 12 that faces it. The apparatus has three heater blocks 40 with heating elements 41. These heater blocks and elements are carried by unshown mechanisms to cyclically converge and diverge in effecting sealing operations.

Figure 9A:
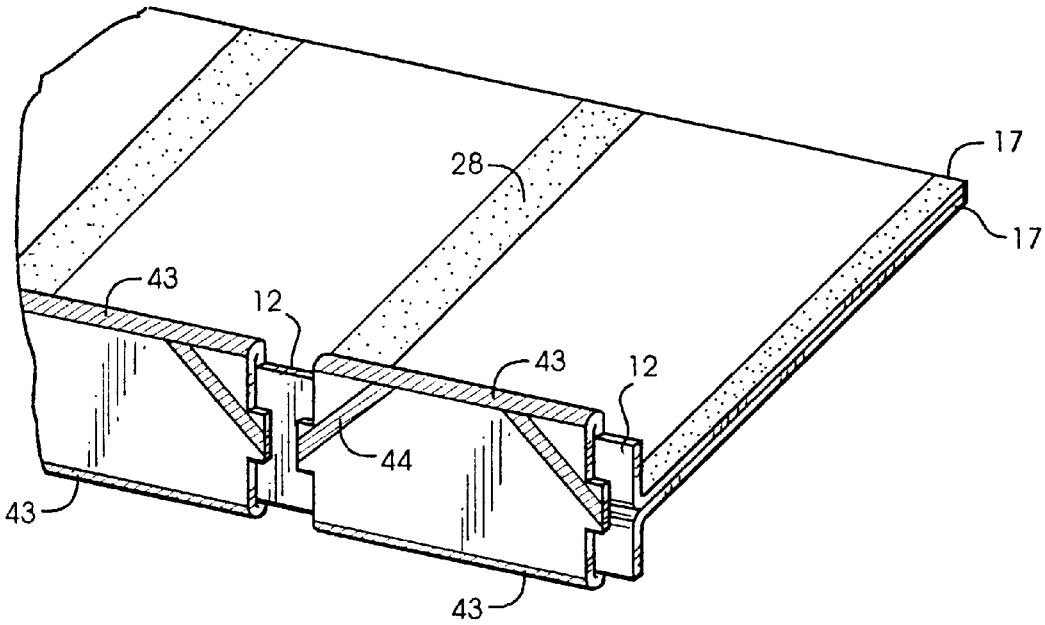
FIGS. 9A, 9B and 10 are perspective views of additional steps taken in sequence following the step shown in FIG. 7.
Figure 9B:
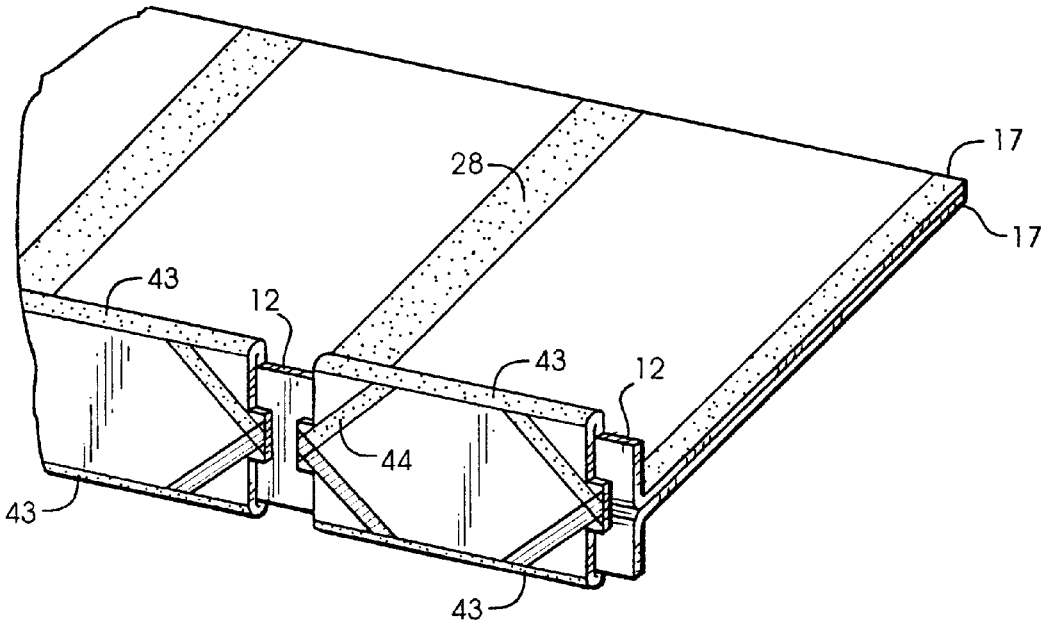
Figure 10:
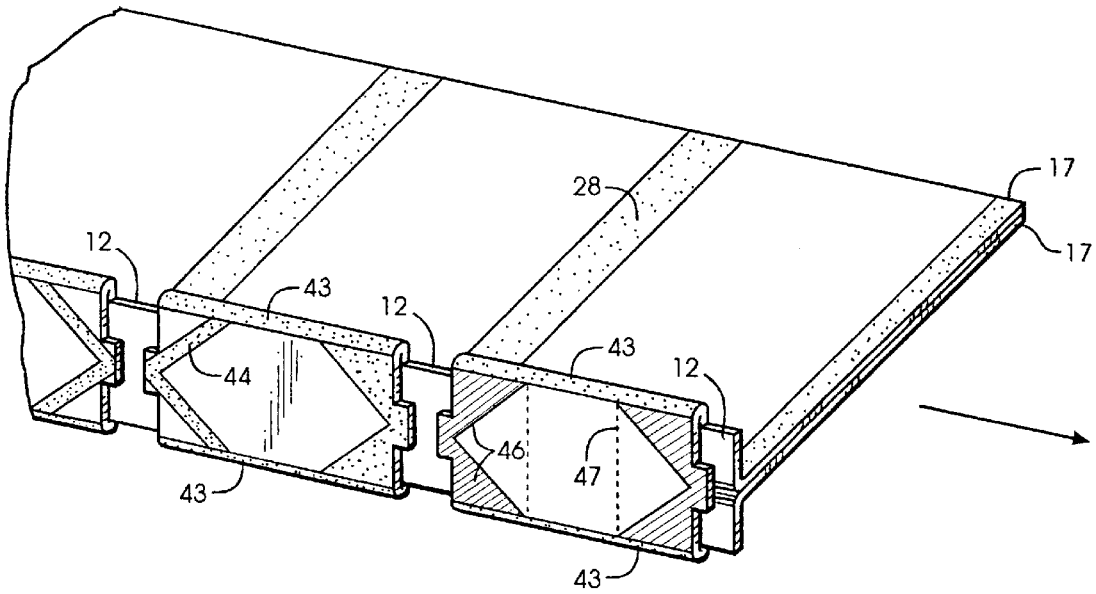

Upon departure from the ends of the forming bar forks 33 bottom edge heat seals 43 are formed which are shown in FIGS. 9A and 9B. FIGS. 9A and 9B also show the formation of V-shaped perimeter seals 44 in the bottom of the web. This is done in a two step operation to effect overlap of the apexes of the V-shaped perimeter seals. As shown in FIG. 10, overseals 46 are then formed which overlap the V-shaped perimeter seals 44. The end bounds of the container bottoms are now visualized by the broken lines 47.

Figure 11A:
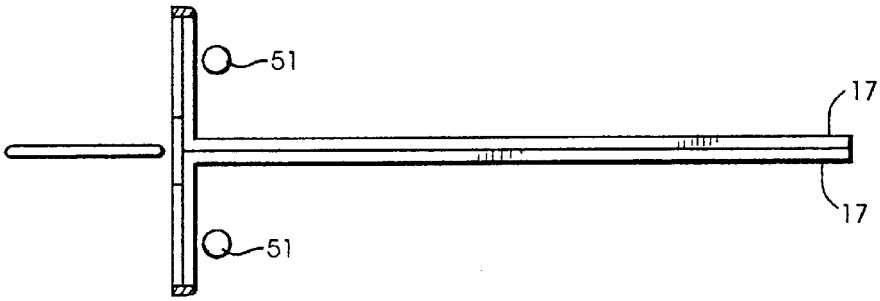
FIGS. 11A and 11B are end views showing a bottom portion of the folded web being refolded upon itself.
Figure 11B:
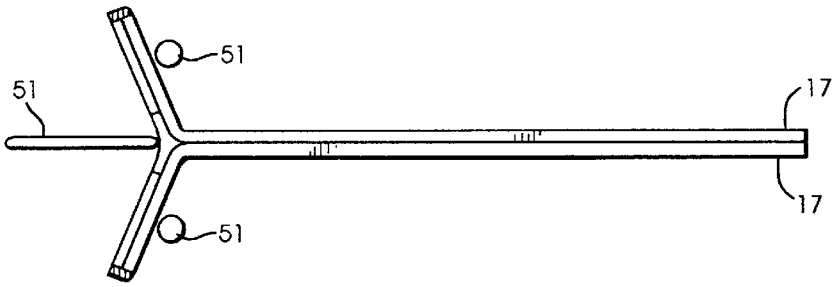
Figure 12:
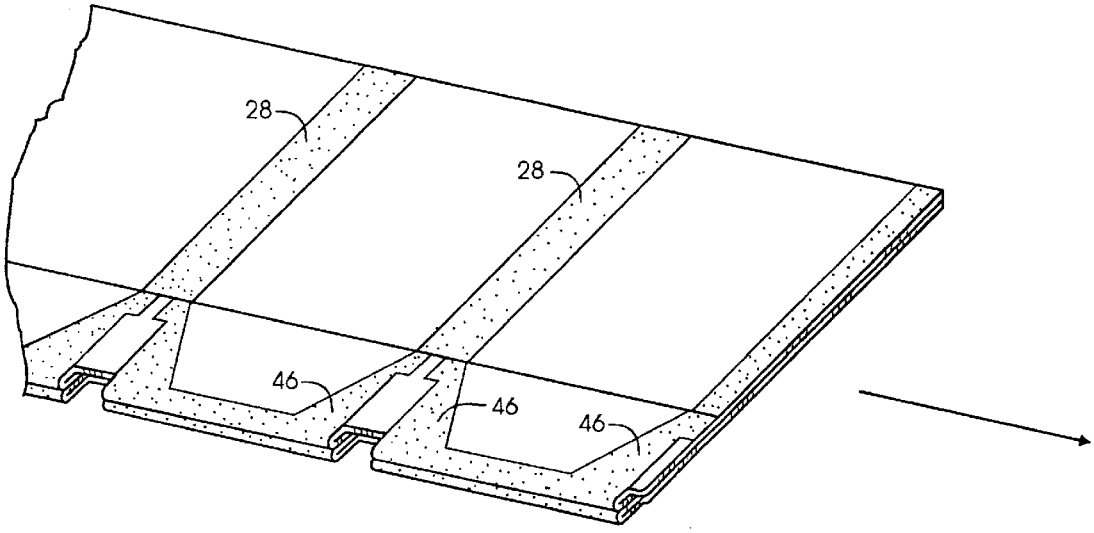
FIGS. 12–16 are perspective views of further steps taken in sequence following the refolding step shown in FIGS. 11A and 11B.
Figure 13:
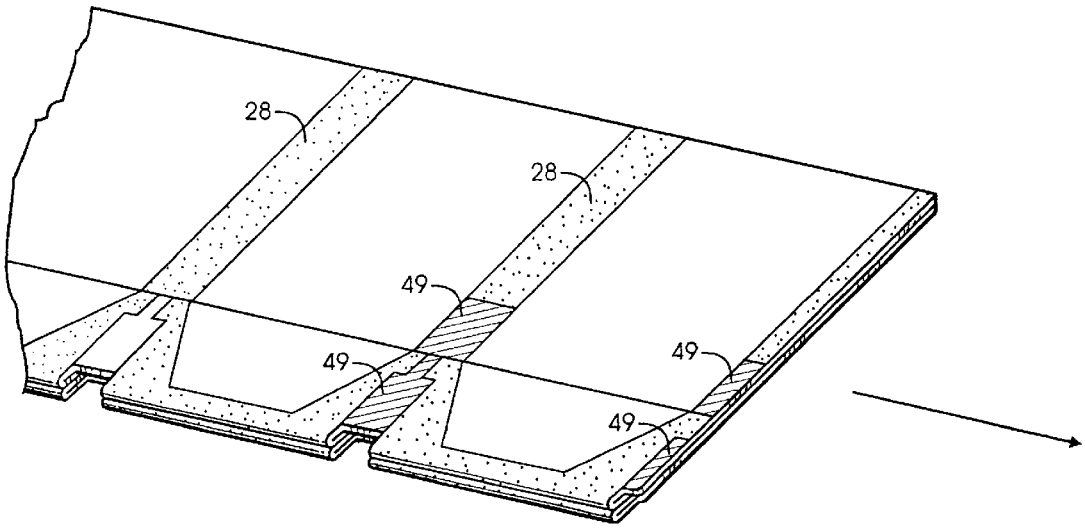
Figure 14:
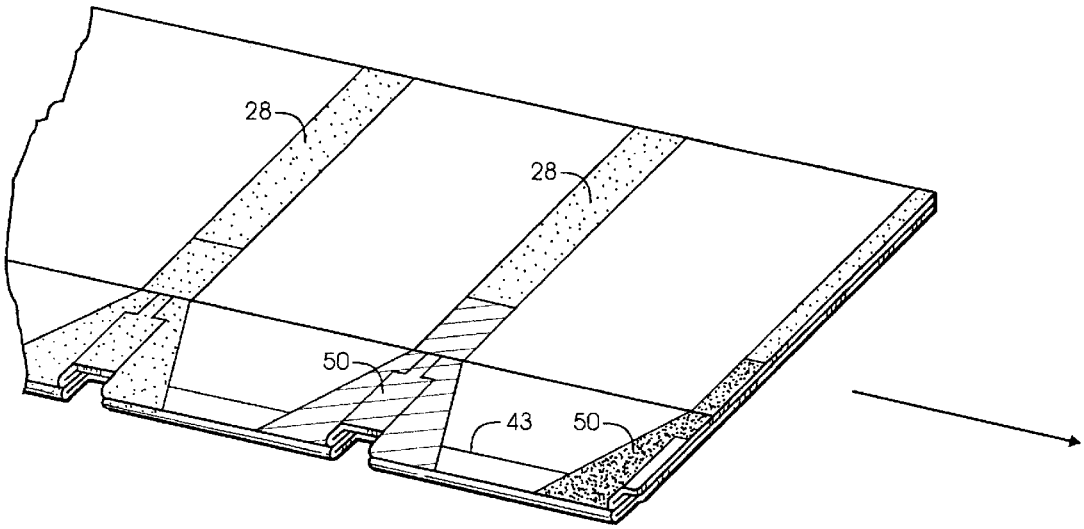
Figure 15:
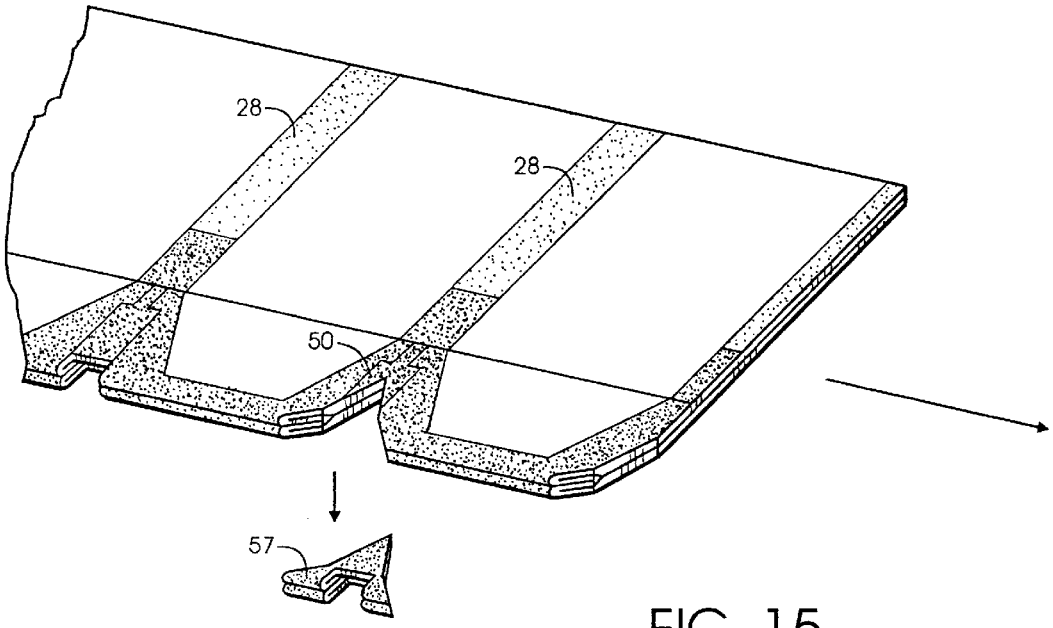
Figure 16:
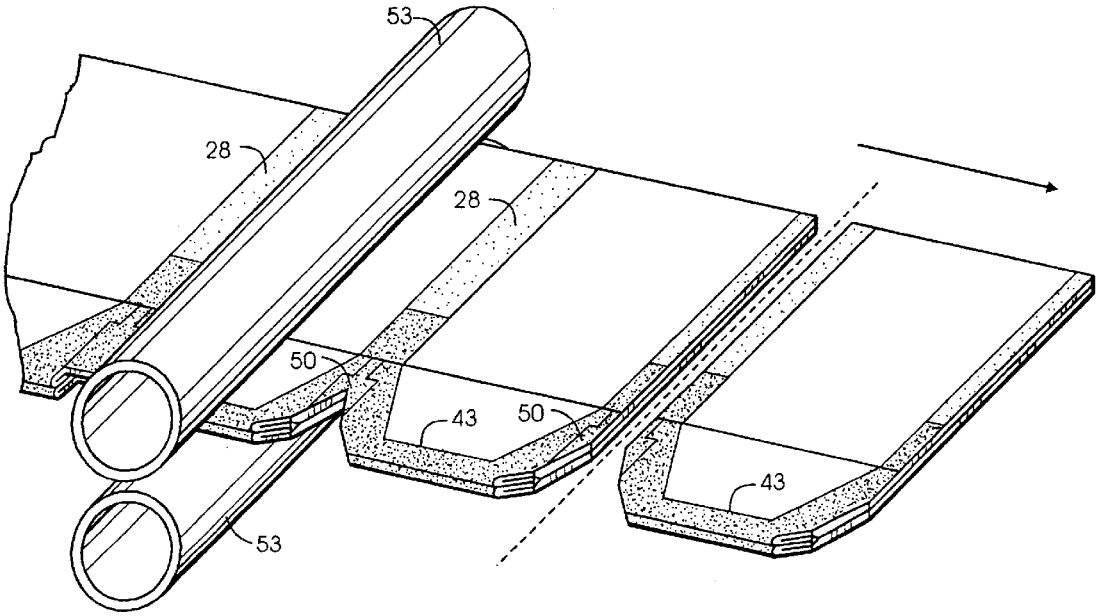
Figure 17:
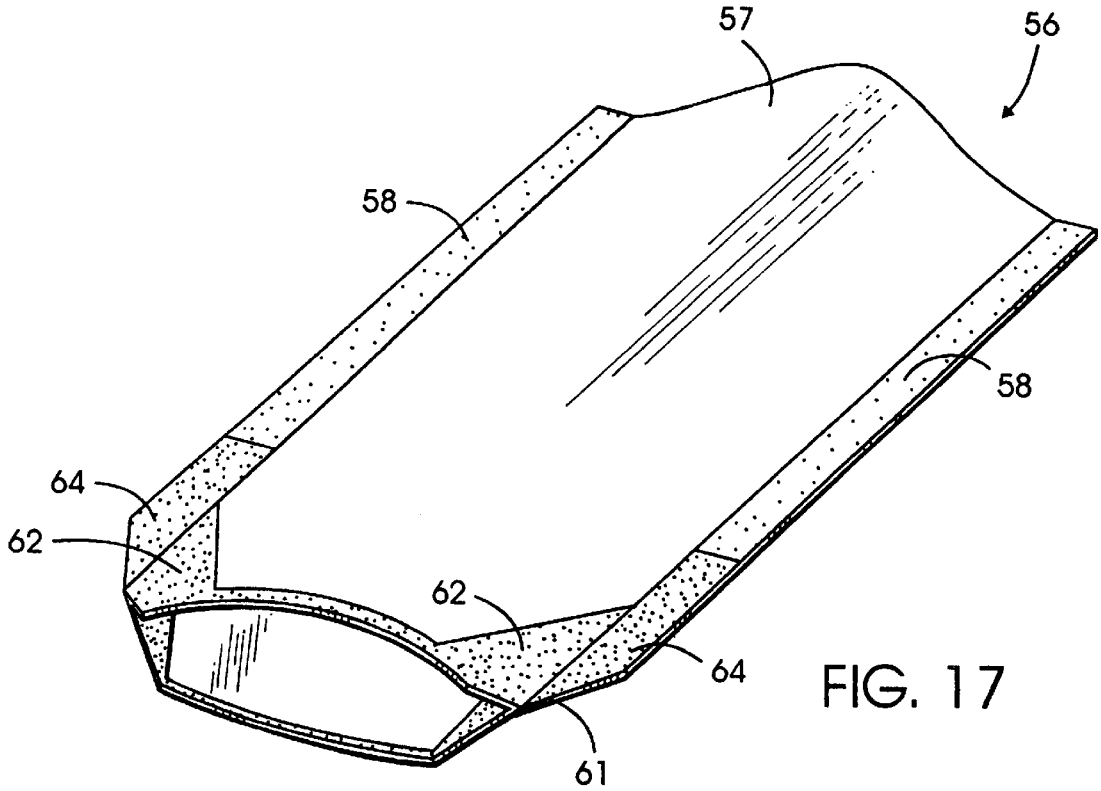
FIG. 17 is a perspective view of an individually formed container being erected which is shown fully erected in FIG. 18.
Figure 18:
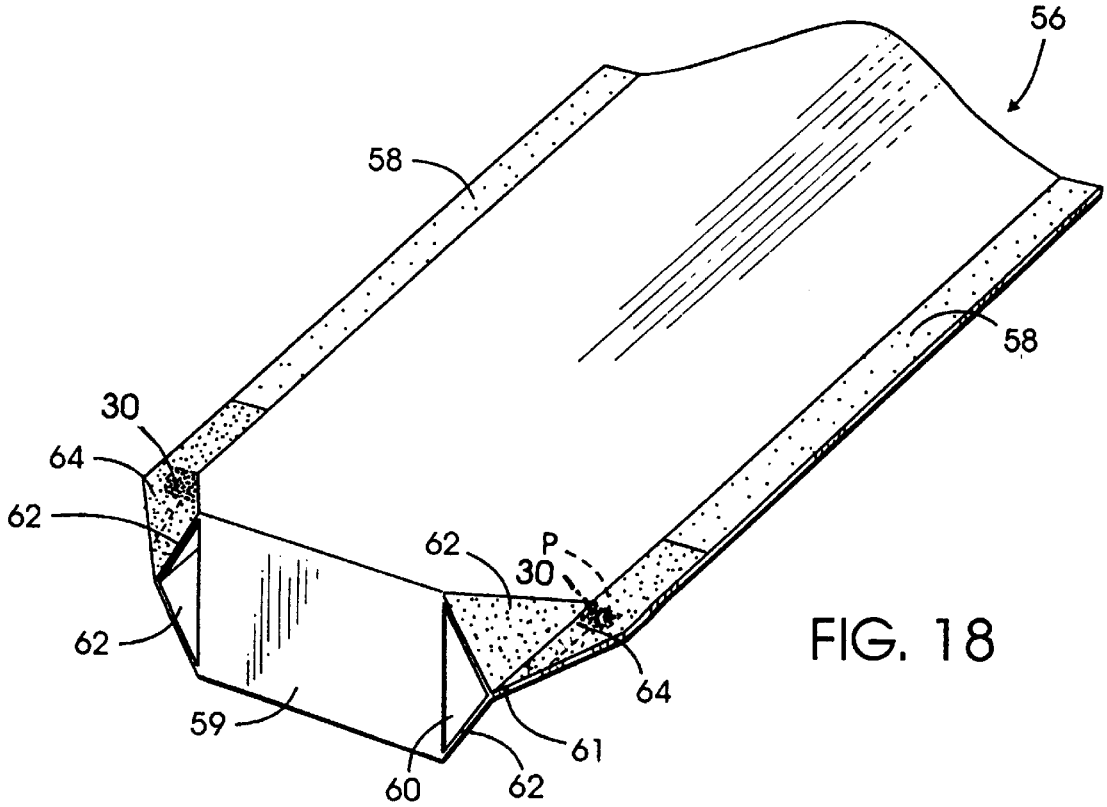

The web is passed over an external apparatus that includes an external folding bar 50 and two guide rails 51 as shown in FIGS. 11A and 11B. The folding bar 50 tapers towards and between the two guide rails as shown by the comparison of FIGS. 11A and 11B. This serves to fold the bottom of the web into the shape shown in FIG. 12 of a doubled layered fork. Additional heat seals 49 are then formed where shown in FIG. 13. Note here that these additional heat seals 49 extend over both the bottom and part ways along the upper section of the web. Again this is done with the sealable polyethylene plies all in face to face abutment. An overseal 50 is next made where shown in FIG. 14. This seals a section of the two layered upper portions of the web to the diagonal border of the bottom portion. A die cutout 54 is then made as shown in FIG. 15. Finally, the web is severed along the center of side heat seal 28 as shown in FIG. 16 just past or downstream of the drive rollers 53. Each severed, single blank container 55 is then erected, as shown in process in FIG. 17, into the finished container 56 configuration shown in FIG. 18.

The container 56 is seen to be of unitary construction having two principal sides 57 sealed along opposite side seams 58, formerly side heat seals 28, and a rectangular bottom 59. Triangular base sections or end walls 60 extend from the ends of the bottom 59 to the side seams at a point P spaced from the bottom end 61 of the side seams. Thus the triangular base sections 60 are straddled by two sealed transitional seams 62 that in turn are joined to form a lower side seam 64 which extends unitarily from side seams 58. This results in the lower portion of the container sides being reinforced along these seams and yet reinforced free of the presence of a capillary formed at the intersection of six converging sealing layers which tend to create capillary leakage. Good web control is maintained during production by the forming bar 23 being between the two layers. The result is a highly efficient method of producing containers that may be made of quite thin materials of sturdy and substantially capillary free construction.

The container also has anti-burst characteristics over those of the prior art. With prior art containers the dropping of such causes the sides to expand upon impact. This swelling of the sides is directly transferred to the intersection of the seams being pulled in opposite directions, which oftentimes results in a breach of the container. With the present invention the container side seams 58 extend to the lower side seams 64 which are formed from the transitional seams 62. As such, should the container be dropped or otherwise caused to expand the majority of the oppositely disposed forces are placed upon the lower side seam 64. Thus, should these forces cause the lower side seam to be pulled apart somewhat the action does not cause a breach in the portion of the container containing liquid.

It thus is seen that a new flexible container and method of manufacturing a flexible container is now provided that overcomes problems associated with those of the prior art. It should be understood however that many modifications, additions and deletions may be made thereto without departure from the spirit and scope of the invention as set forth in the following claims.

What is claimed is:

1. A container made of a sheet of flexible plastic material having two opposed side walls joined to each other along two oppositely disposed first side seams, a bottom wall extending between said side walls, two opposed generally triangular-shaped end walls extending between said bottom wall and said side walls, each said end wall being joined to said side walls along two transitional seams extending from said first side seams, said transitional seams being also joined to each other along a second side seam having a peripheral edge unitarily extending from said first side seams and a tab extending from the transitional seams that is captured within said second side seam spaced from said second side seam peripheral edge with all edges of said tab in intimate contact with said second side seam.

2. A container made of a sheet of flexible plastic material having two opposed side walls, a bottom wall extending between said two side walls, and two opposed generally triangular-shaped end walls extending between opposed ends of said bottom wall and said two side walls, and wherein said two side walls are sealed to each other by two side seams that have bottom portions that extend over said two end walls, and wherein said each of said end walls are sealed to said side walls along two transitional seams that are joined to each other along said side seams bottom portion with a transitional seam tab extending therefrom that is captured within said side seam bottom portions, and wherein said side seams bottom portions have peripheral edges and wherein said transitional seams projections tabs are spaced from said side seams peripheral edges.

* * * * *